United States Patent [19]

Jaecklin

[11] Patent Number: 4,930,939

[45] Date of Patent: Jun. 5, 1990

[54] WALL WITH GRAVITY SUPPORT STRUCTURE, BUILDING ELEMENT AND METHOD FOR CONSTRUCTION THEREOF

[76] Inventor: Felix P. Jaecklin, Geissbergstr. 46, CH-5400 Ennetbaden, Switzerland

[21] Appl. No.: 301,386

[22] Filed: Jan. 25, 1989

Related U.S. Application Data

[63] Continuation-in-part of Ser. No. 904,643, Sep. 8, 1986, Pat. No. 4,818,150.

[51] Int. Cl.[5] ..... E02D 29/02; E02D 17/20

[52] U.S. Cl. ..... 405/262; 405/258; 405/284

[58] Field of Search ..... 405/284, 285, 286, 287, 405/272, 258, 262

[56] References Cited

U.S. PATENT DOCUMENTS

| | | | |
|---|---|---|---|
| 3,922,864 | 12/1975 | Hilfiker | 405/286 X |
| 4,117,686 | 10/1978 | Hilfiker | 405/284 |
| 4,329,089 | 5/1982 | Hilfiker et al. | 405/262 |
| 4,391,557 | 7/1983 | Hilfiker et al. | 405/284 X |
| 4,490,075 | 12/1984 | Risi et al. | 405/286 X |
| 4,512,685 | 4/1985 | Hegle | 405/284 |
| 4,521,138 | 6/1985 | Steiner | 405/286 X |
| 4,557,634 | 12/1985 | Vidal | 405/286 |
| 4,671,706 | 6/1987 | Giardini | 405/286 |

FOREIGN PATENT DOCUMENTS

| | | | |
|---|---|---|---|
| 2626650 | 12/1977 | Fed. Rep. of Germany | 405/258 |
| 2826324 | 12/1979 | Fed. Rep. of Germany | 405/286 |
| 747703 | 4/1933 | France | 405/287 |
| 0134969 | 4/1979 | German Democratic Rep. | 405/284 |
| 0291621 | 12/1931 | Italy | 405/258 |
| 0036548 | 3/1980 | Japan | 405/286 |
| 0089536 | 7/1980 | Japan | 405/284 |
| 0133928 | 8/1982 | Japan | 405/258 |
| 0204224 | 11/1983 | Japan | 405/286 |
| 7904901 | 12/1980 | Netherlands | 405/284 |
| 0657651 | 9/1986 | Switzerland | 405/285 |
| 0647391 | 2/1979 | U.S.S.R. | 405/284 |
| 1485004 | 9/1977 | United Kingdom | 405/284 |
| 2073281 | 10/1981 | United Kingdom | 405/284 |
| 2102866 | 2/1983 | United Kingdom | 405/284 |

*Primary Examiner*—Dennis L. Taylor
*Attorney, Agent, or Firm*—Lalos & Keegan

[57] ABSTRACT

The wall according to the present invention comprises a gravity support structure with a plurality of compartments or cells which are filled with bulk material and surrounded or subdivided by flat and flexible envelope material, and on one front side or on both opposite front sides of this gravity support structure a forepart, preferably in the form of a supporting grid structure, which is positively or frictionally connected with said gravity support structure. Such combined wall structure can be used for slope supporting as well as for noise absorbing or partition purposes, in the latter cases e.g. in the form of a stand-alone structure. An essential function of the foreparts is the protection of the front portions of the envelope material holding the bulk material filling against violation and solar irradiation. The stability of the combined wall is greatly enhanced by anchoring the foreparts to the gravity support structure by means of comparatively inexpensive tensile elements.

11 Claims, 13 Drawing Sheets

WALL WITH GRAVITY SUPPORT STRUCTURE, BUILDING ELEMENT AND METHOD FOR CONSTRUCTION THEREOF

RELATED APPLICATIONS

This application is a continuation-in-part of U.S. Application Ser. No. 904,643, filed Sept. 8, 1986 now U.S. Pat. No. 4,818,150.

BACKGROUND OF THE INVENTION

Walls constructed as a gravity support structure with bulk material cells enveloped by flexible flat material such as foils or tissue of synthetic resins or plastic material are well known. They are in use particularly for supporting slopes. The front side of such a gravity support structure generally is formed by the front portions of the bulk material compartments or cells, i.e. by the front portions of the envelopes, which stand under the internal pressure of the bulk material filling and which form convex vaults. The bulk material cells superimposed on each other are in mutual positive or at least frictional, shear resistant connection. This results in an enhanced stability and support capability, especially against the horizontally acting pressure component of a slope located behind the gravity support structure. Due to their simple production and reduced expense there is an increasing demand for the application of such structures.

However, there are problems due to the envelope material being susceptible to piercing or tearing with the consequence of the bulk material running out and leaving the structure unstable. Further, difficulties arise from the sensitiveness of the envelope material against solar irradiation. Providing an earth slope in contact with the front of the structure, which could shield the envelope against irradiation and facilitate planting, generally is difficult in view of poor connection between the smooth surface of the envelope material and the earth of the slope. This leads to separation due to natural settling of the earth and to undesired exposition of the envelope material.

SUMMARY OF THE INVENTION

It is an object of the invention to create a wall construction comprising a gravity support structure with a plurality of cells which are filled with bulk material and surrounded or subdivided by flat and flexible envelope material, in which the front faces of said compartments and particularly the exposed portions of the envelope material are efficiently protected, whilst the advantages concerning stability and inexpensive production are preserved, particularly in the case of constructions with comparatively steep front faces.

This object is achieved by a wall construction comprising a gravity support structure with a plurality of cells which are filled with bulk material and surrounded or subdivided by flat and flexible envelope material, the wall being provided with at least one forepart which is positively or frictionally connected with said gravity support structure at least with regard to horizontal forces acting between said forepart and said gravity support structure.

The structure offers essential advantages over the usually designed walls merely consisting of a supporting grid composed of frame-like elements. A major part of the structure volume and weight required to provide the tilting resistance or slope supporting capability can be realized by the gravity support structure and can be much less expensive. The foreparts make it possible to provide a front face structured by ribs and recesses so as to offer the best noise absorption and to form receptacles for earth to bear plants, particularly in the case of a grid support structure filled with earth as forepart.

Due to the gravity support structure taking over a great part of the stabilizing function the foreparts can be reduced considerably as to their dimensions, especially their wall thickness, and accordingly to the expenses.

For the purpose of anchoring the foreparts to the gravity support structure, preferably appropriate portions of the envelope material already present in the gravity support structure may be used. In the case of a stand-alone wall with two foreparts on opposite front sides of a centrally located gravity support structure, stability may be further enhanced substantially without additional expense by connecting the opposite foreparts or certain building elements thereof, which preferably are located on proximate levels, directly with each other by means of tensile anchoring elements extending through the central gravity support structure.

Certain building elements as disclosed and claimed hereinafter and being useful in the construction of walls of the kind just defined are within the scope of the present invention.

An essential variation also lying within the scope of the present invention is accomplished by a wall, particularly constructed as a slope-supporting wall or a stand-alone wall such as a noise-absorbing or partition wall, comprising a gravity support structure with a plurality of cells which are filled with bulk material and surrounded or subdivided by flat and flexible envelope material, the wall being provided with at least one forepart which is constructed so as to be tilt-resistant in itself and arranged without substantial force transmission in relation to the gravity support structure.

This solution is applicable particularly in cases where stability is not the critical point and served well by a comparatively heavy gravity support structure as well as by the forepart, i.e. by both components substantially independent from each other. Preferably, this may be valid for one-side foreparts in contrast to stand-alone walls. The essential feature of the invention used in such variations is the protective function of the forepart with regard to the front of the gravity support structure with its sensitive envelope material.

Effective and comparatively inexpensive methods for constructing walls according to the last-mentioned variation, which particularly facilitate holding the forepart free of the bulk material pressure within the cells of the gravity support structure, as disclosed and claimed hereinafter are also within the scope of the invention.

DETAILED DESCRIPTION OF THE INVENTION

Figure 1:
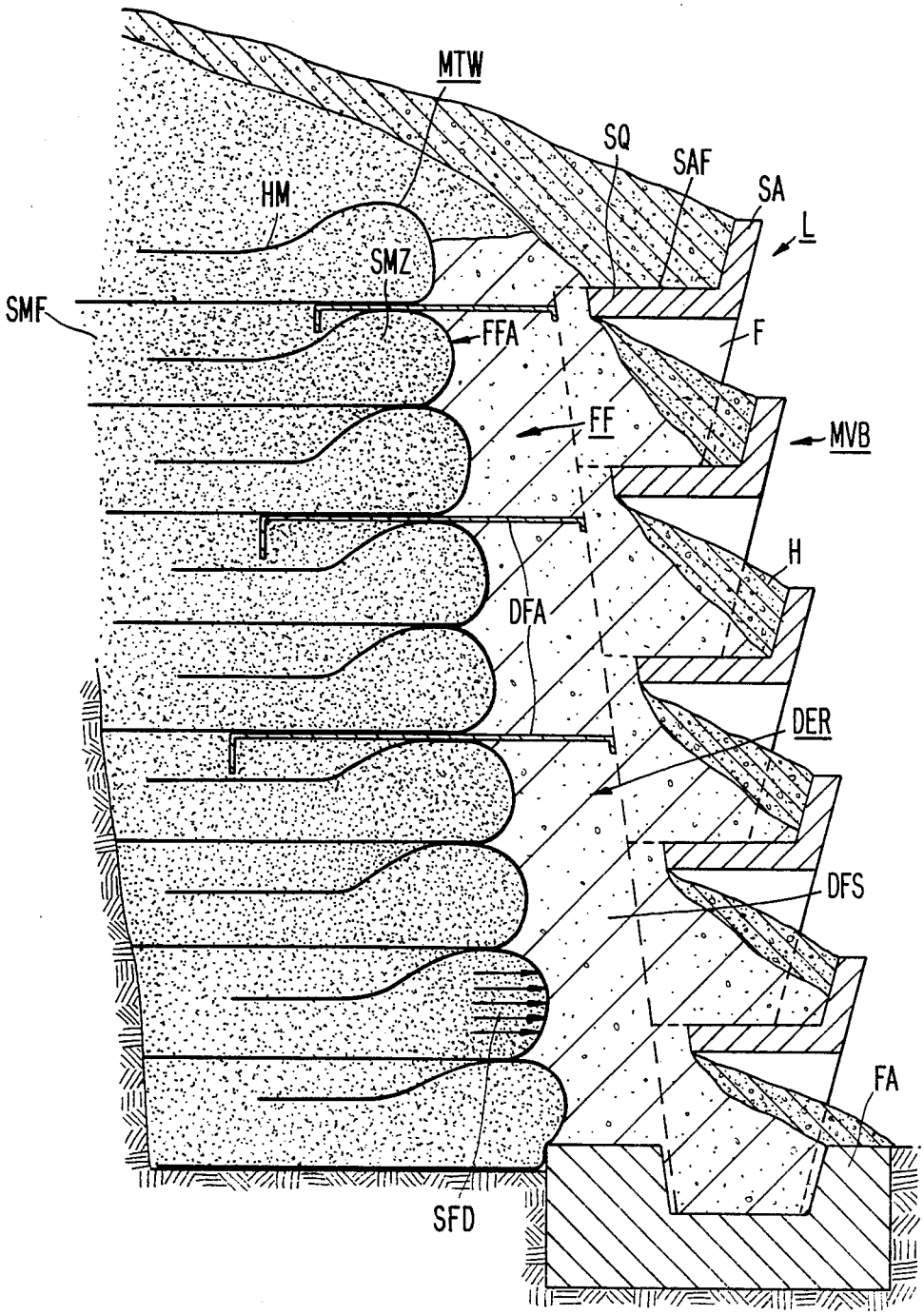
FIG. 1 is a cross-sectional elevationaI view of a slope supporting wall with bulk material compartments superimposed on a flat material envelope.

The invention now will be explained more in detail with reference to the examples schematically shown in the drawings.

The example of FIG. 1 is a slope supporting wall including a gravity support structure MTW consisting of superimposed compartments or cells SMZ with a bulk material filling SMF and a flexible flat material envelope HM. The front face FF of the gravity support structure is formed by front portions FFA of the envelopes carrying the horizontal component of the bulk material pressure SFD and being vaulted thereby. In front of the face FF there is a pressure relief space DER containing pressureless or low-pressure filling DFS of comparatively incompact or low-densified bulk material. Distance elements DFA arranged to extend through the pressure relief space DER are anchored with their rear ends between horizontal boundaries of cells SMZ so as to transfer substantially no bulk material pressure in a direction from the gravity support structure to a forepart MVB located in front of space DER, but rather to transfer support forces from the forepart backwards into the gravity support structure. The forepart MVB consists of elements L superimposed to each other and resting on a base FA. Elements L are formed as longitudinal beams extending in parallel to the wall, which has been shown in a vertical section, and comprise a transverse profile leg SQ as well as an upright profile leg SA and base sections F holding distance from the lower adjacent building element L. On their upper surface the profile legs SQ form a bearing face SAF for the parts of bulk material filling DFS running through the horizontal distances between adjacent base sections F and for a superimposed humus layer H intended to carry plants. Due to the small dimensions of its building elements in a direction transverse to the wall and due to the small bearing surfaces between adjacent building elements the forepart MVB has only little inherent stability and, therefore, is secured against tilting by its inclined position with leaning against the gravity support structure through distance elements DFA and eventually through low-pressure filling DFS. The forepart thus can be of comparatively light and inexpensive construction, nevertheless fulfilling its protective function for the sensitive front face FF as well as offering optimum conditions for noise absorption, planting and esthetic appearance at the wall front.

Figure 2:
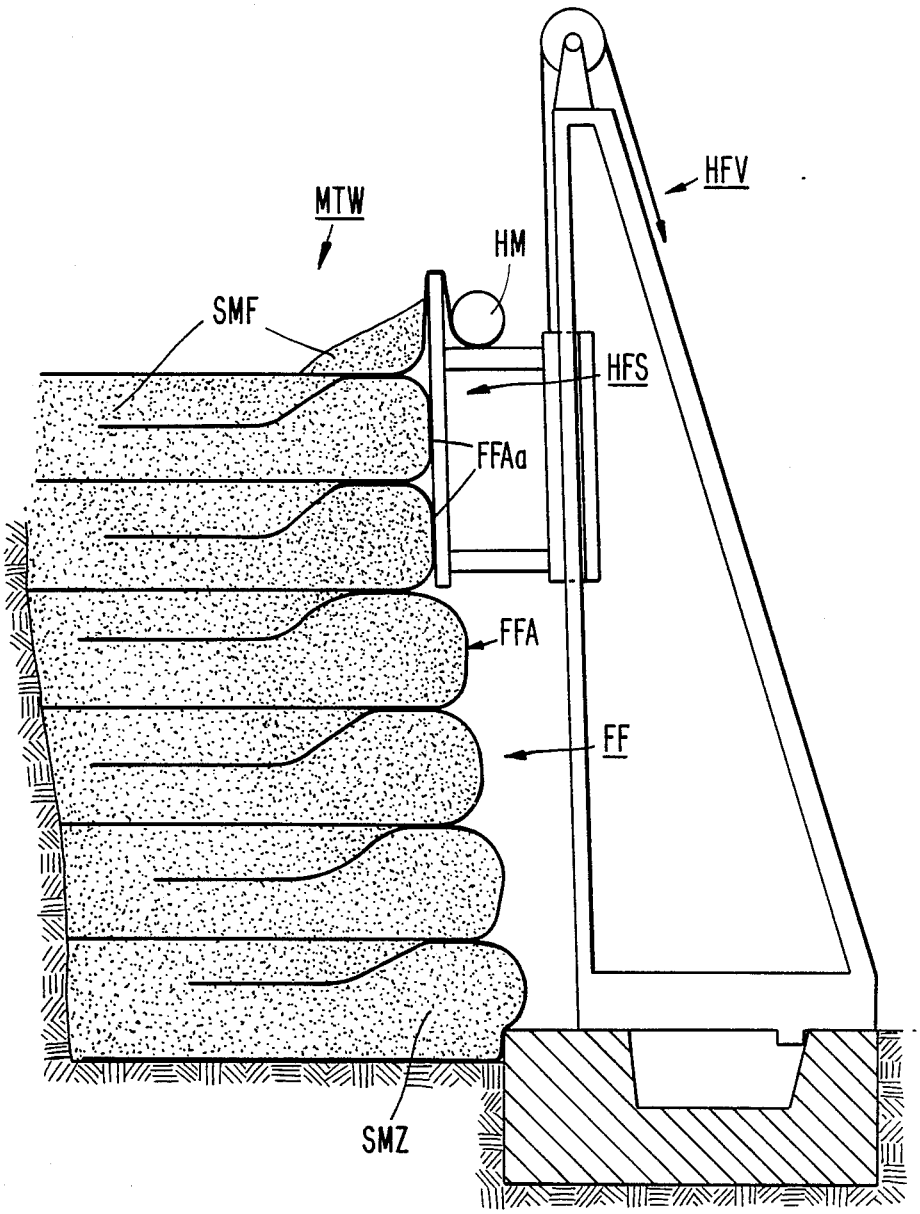
FIG. 2 is an elevational view of a slope supporting wall and apparatus for constructing the wall according to a first method.
Figure 3:
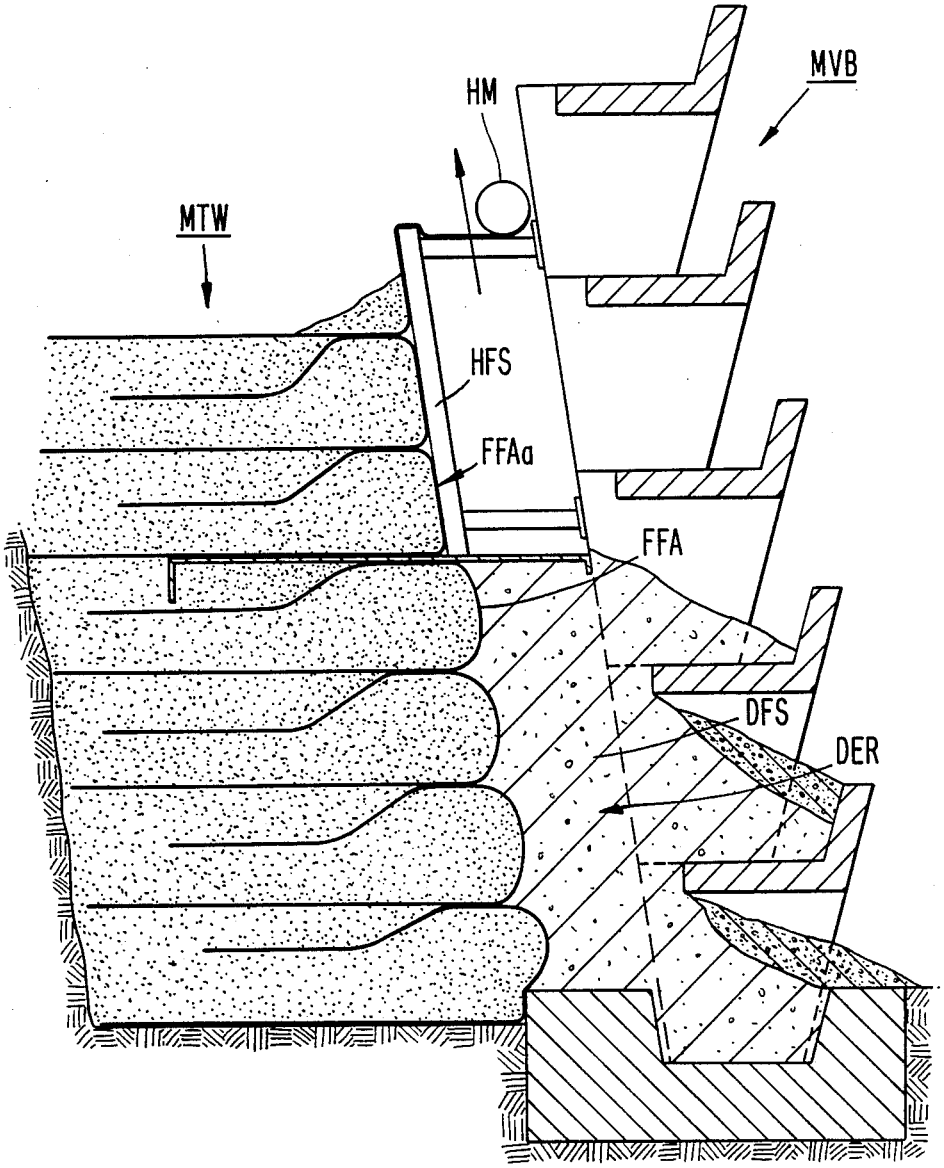
FIG. 3 is an elevational view of a slope supporting wall and apparatus for constructing the wall according to a second method.

Manufacture of the wall according to FIG. 1 can be accomplished by using the methods illustrated in FIGS. 2 and 3 respectively.

According to FIG. 2, first, the gravity support structure MTW is erected by sections with the aid of an auxiliary shuttering HFS supporting the envelope front portions FFA by sections. For this purpose the shuttering HFS can be lifted by means of an elevating and guiding device HFV. Below the momentary working position of the auxiliary shuttering shown in the upper part of FIG. 2 with supported front portions FFAa, the front face FF is relieved from the shuttering such that the envelope front portions FFA can come under tension and balance the bulk material pressure SFD. Thereafter, the forepart MVB can be erected without being disturbed by pressure coming from the supported slope or from the bulk material filling. Then the low-pressure filling DFS is introduced together with positioning the distance elements DFA.

In contrast thereto, according to FIG. 3, first, the forepart is erected as a whole or by sections. Then the gravity support structure is erected by sections with the aid of movable auxiliary shuttering HFS, which at any time has to balance merely a small part of the bulk material pressure acting in a few cells of the gravity support structure and, therefore, is allowed to be supported intermediately by the forepart. Below the auxiliary shuttering the envelope material of the front face is tensioned by the bulk material pressure, thus far relieving the forepart. The low-pressure filling and distance elements can be introduced by steps correspondingly so as to definitely support the forepart in a horizontal direction and to accomplish sufficient stability.

FIG. 4 illustrates, again in a vertical cross-section, a forepart MVBa having no inherent stability and comprising building elements L of the kind having longitudinal beams with groove profile and base elements FE. Such forepart has stability only through the positive connection with the previously erected gravity support structure MTW by means of anchoring elements VAZ, VAZa or VAZb respectively, which are constructed so as to transfer tensile forces. The forepart is relieved from the horizontal slope pressure and bulk material pressure due to its compliance.

The anchoring element VAZ is connected to the gravity support structure by means of a holding part HE embedded in the bulk material filling SMF. The same is valid for anchoring element VAZa with regard to holding part HEa, which supports itself between converging envelope sections and transfers its tensile force through a rope-like, elastic connection part AEW to the forepart MVBa in a manner adaptive to transversal displacement. Thereagainst, anchoring elements VAZb and VAZc are connected positively or bondingly in a concentrated or distributed manner to substantially horizontal or slowly inclined extending sections of the envelope material HM by means of differently shaped connection elements VS capable of transferring shear forces. For the anchoring element VAZb provision is made for a particularly simple, frictional connection to the corresponding building element L of forepart MVBa, which connection is effective under load by a bulk material in the groove profile of said front building element L.

Figure 5:
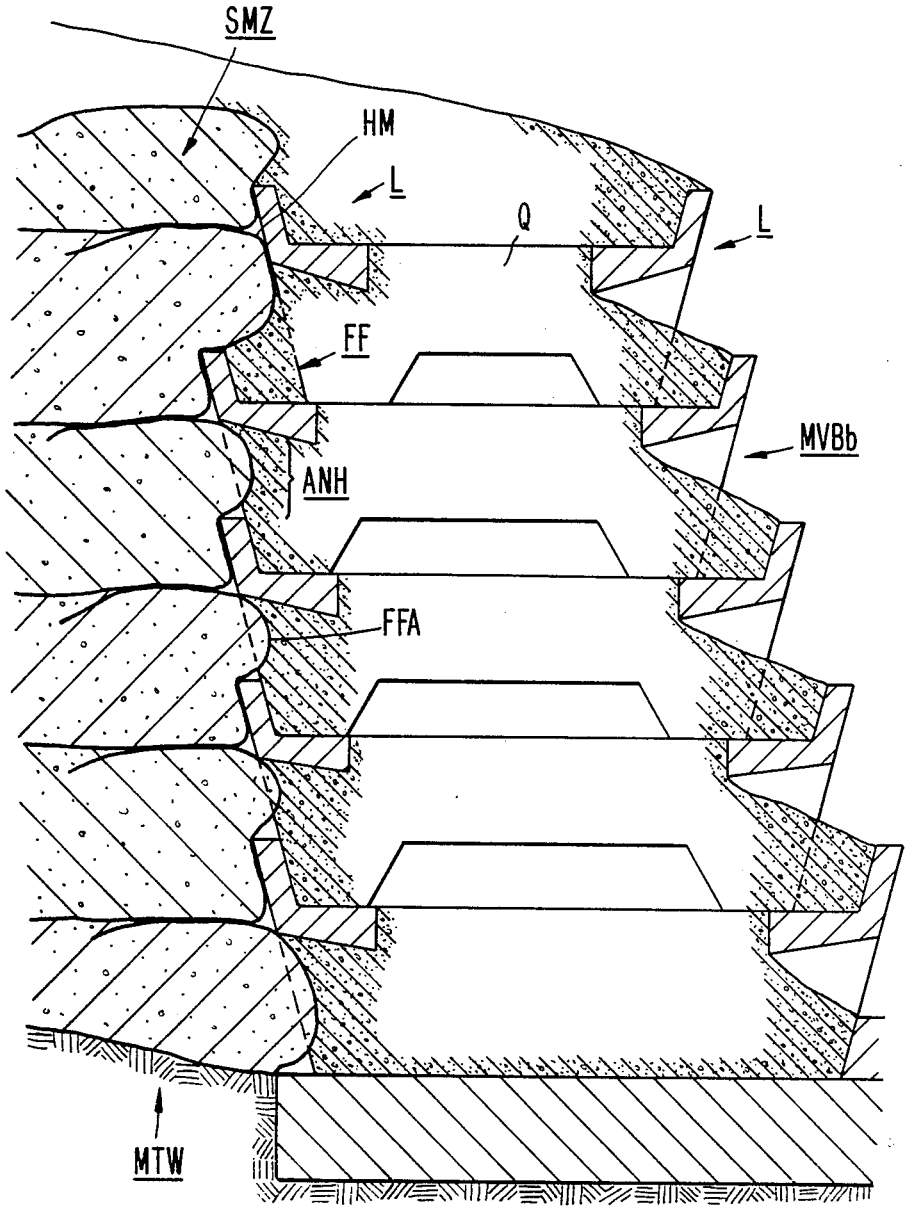
FIG. 5 is a cross-sectional view of a slope supporting wall with transverse beams for enhanced wall stability.

FIG. 5 illustrates a forepart MVBb of enhanced inherent stability with superimposed corner-profile longitudinal beams L and transverse beams Q having a great depth measured in a direction transverse to the wall as well as their own bulk material filling enhancing the stability. On the backside of forepart excavations ANH are formed between the superimposed building elements. Convex vaulted envelope front-t portions FFA standing under the bulk material pressure are arranged to engage these excavations so as to form a positive connection. The wall as a whole is of enhanced compound stability and support capability, suitable for carrying extremely heavy loads. In case there is a distance space between the gravity support structure and the forepart, providing a highly densified bulk material therein is favored.

Figure 6:
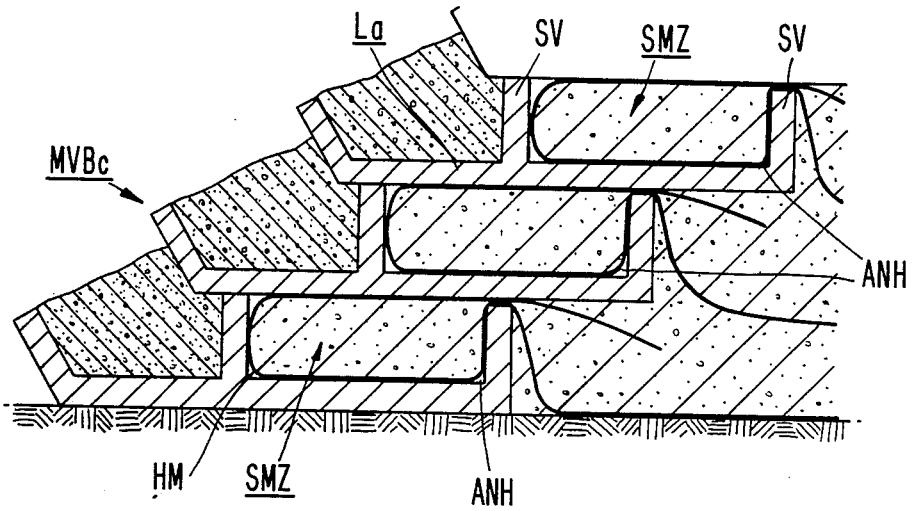
FIG. 6 is a cross-sectional view of a slope supporting wall including longitudinal ribs for forming a positive connection between the forepart of the wall and the main support structure of the wall.
Figure 7:
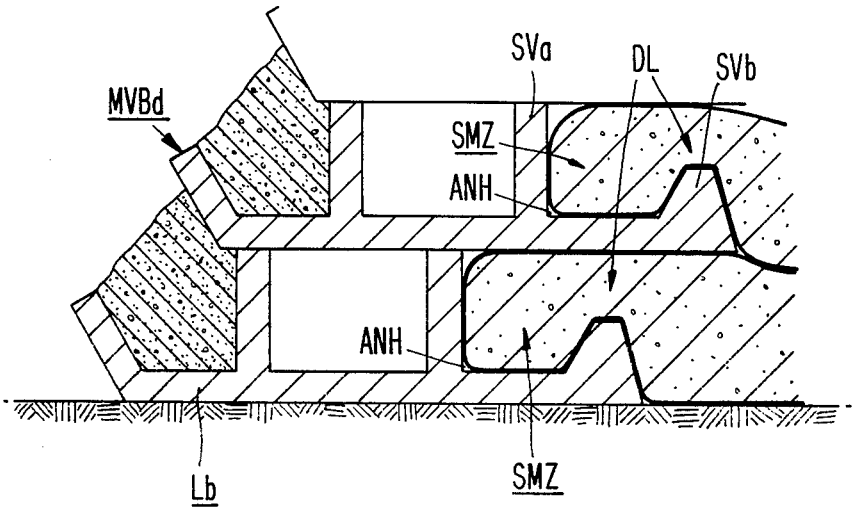
FIG. 7 is a variation of the slope supporting wall shown in FIG. 6 in which the height of the ribs is reduced.
Figure 8:
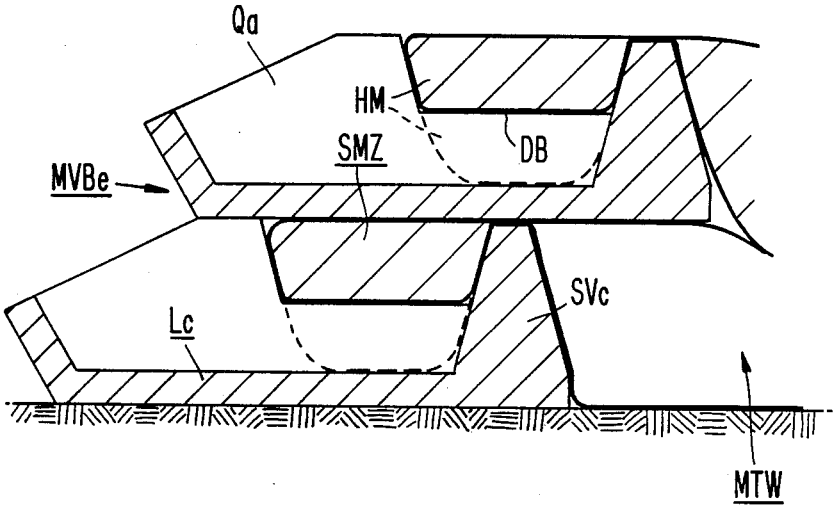
FIG. 8 is a cross-sectional side view of a slope supporting wall in which the forepart comprises trough like building elements.

FIGS. 6 to 8 further illustrate positive connections between foreparts MVBc, MVBd and MVBe, which are space grid support structures comprising groove profile beams La, Lb and Lc respectively as superimposed building elements and a gravity support structure MTW arranged behind the foreparts. To be pointed out for all these variations is the simplicity as well as efficiency of the tensile connection between forepart and gravity support structure in all these variations. Therefore, these constructions are particularly suitable with regard to foreparts without inherent stability in connection with a gravity support structure.

Tensile anchoring is accomplished by means of enveloped bulk material cells SMZ, the pocket-like front portions thereof engaging excavations ANH of the forepart. Behind such excavations, i.e. adjacent to the gravity support structure, there are projections directed upwards and acting as abutments for tensile forces transferred by the bulk material cells.

In the examples as shown the projections are formed by ribs or profile legs extending substantially in parallel to the plane of the wall, however, if desired they can be shaped as single elements, particularly in a serial arrangement, on the building elements of the forepart.

According to FIG. 6 an excavation ANH is formed between two longitudinal ribs or profile legs SV, the cross-section of which is directed upwards. The back one of these ribs or profile legs is acting as an abutment for tensile forces. The corresponding conditions apply to the variation according to FIG. 7, which has two longitudinal ribs SVa and SVb, the latter again acting as an abutment for tensile forces. It has an upper edge of reduced height so as not to squeeze off the bulk material cell housed in the excavation, but rather to offer a greater passage for connection thereof with the gravity support structure. This facilitates the desired filling equalization of the bulk material in the construction of the wall and, therefoRe, an easier and more precise filling up of the excavations, thus establishing a correct positive connection.

Figure 9:
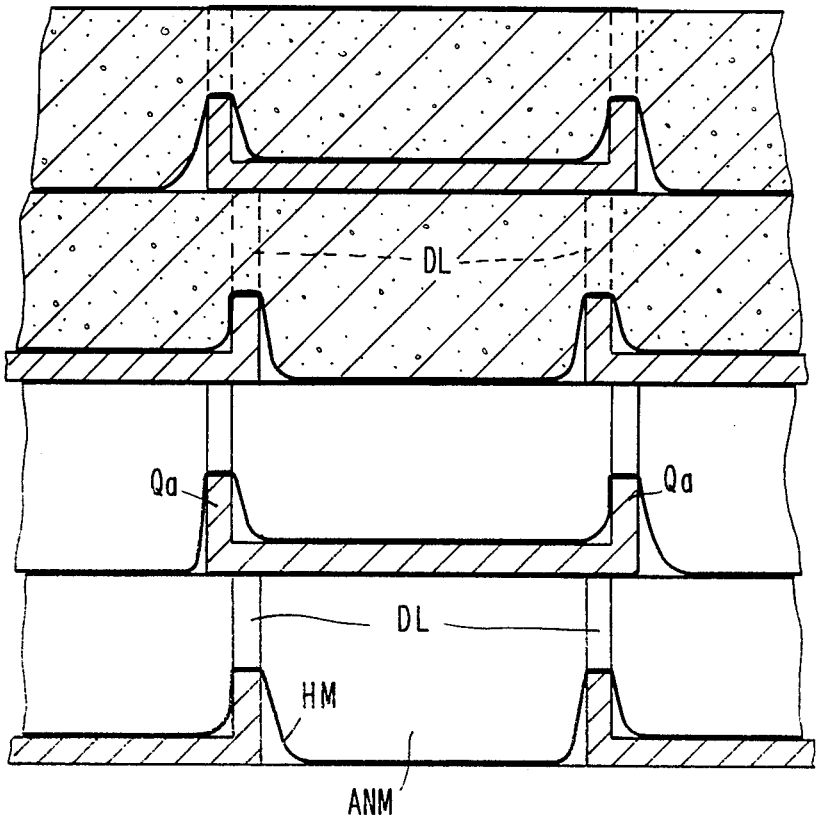
FIG. 9 is a cross-sectional front view of the slope supporting wall shown in FIG. 8.

In the variation according to FIGS. 8 and 9, showing a vertical cross-section and a vertical longitudinal section respectively, the forepart consists of trough-like, comparatively narrow building elements Lc with longitudinal back rib SVc and transversal walls Qa on both sides. Both walls Qa have upper edges of equal height so as to offer a security and tilt-resistance for the superimposed building element Lc. Passages DL formed in said transversal walls Qa ensure that each bulk material cell SMZ can be arranged so as to extend over several building elements or the whole wall without excessive strain and stress arising in the envelope material due to multi-dimensional distortions.

It has to be understood that the forepart, if desired, can be constructed by using building elements of great surface dimensions, e.g. extending substantially over the height and/or over the width of the wall. Particularly, building elements of unique structure, which also have to be taken in consideration, may be constructed with comparatively small wall thickness.

Figure 10:
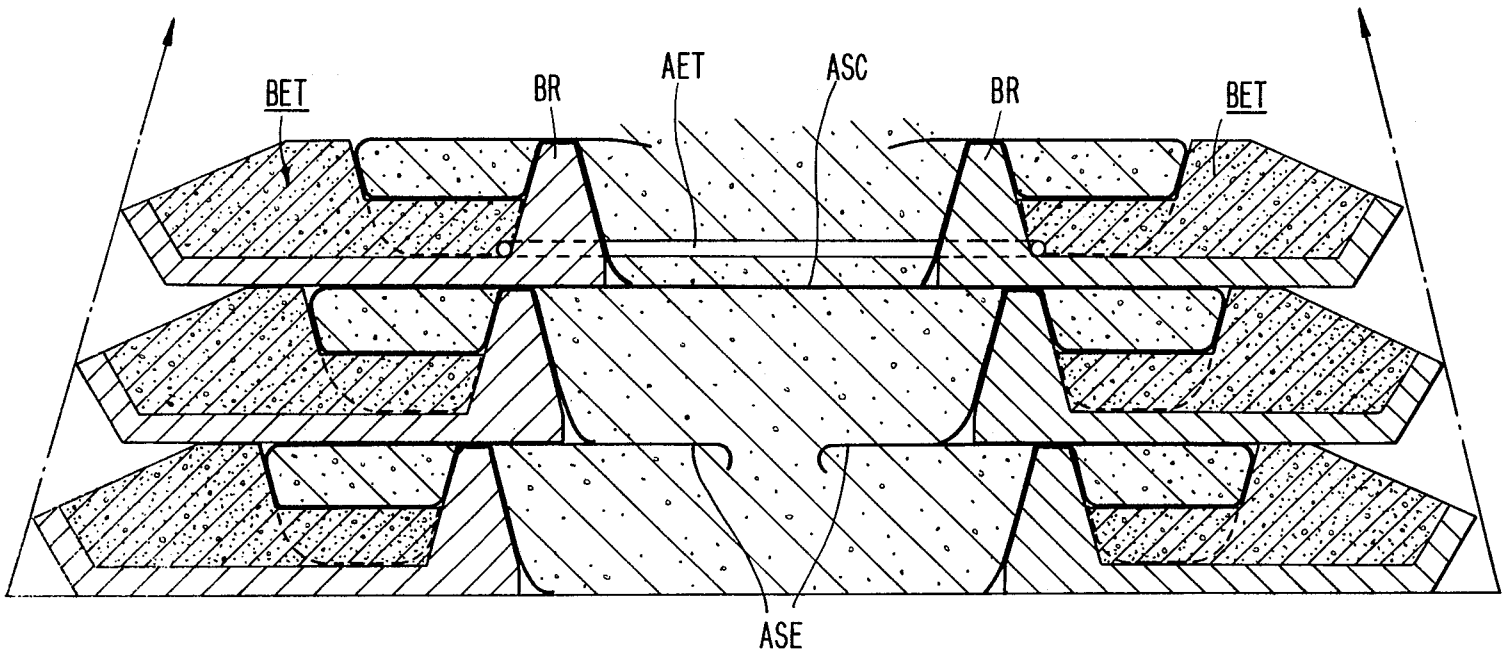
FIG. 10 is a cross-sectional side view of a stand-alone wall with opposite foreparts comprised of trough like building elements as shown in FIG. 8.

FIG. 10 illustrates, as a further example, a stand-along wall, which can serve as a noise-absorbing or partition wall and which comprises a gravity support structure with a plurality of cells filled with bulk material and surrounded by flat and flexible envelope material. All this is in accordance with the preceding examples so that no detailed explanation is necessary thus far. Beyond the preceding examples, the wall is provided with two opposite front sides formed by corresponding foreparts FP1, FP2 and with a central gravity support structure CGS. The latter again comprises a plurality of compartments or cells which are filled with bulk material and surrounded or subdivided by flat and flexible envelope material FEM. The foreparts are constructed similar to the one according to FIG. 8, i.e. consisting of superimposed, trough-like building elements BET with a back rib BR extending in longitudinal direction of the wall.

Figure 4:
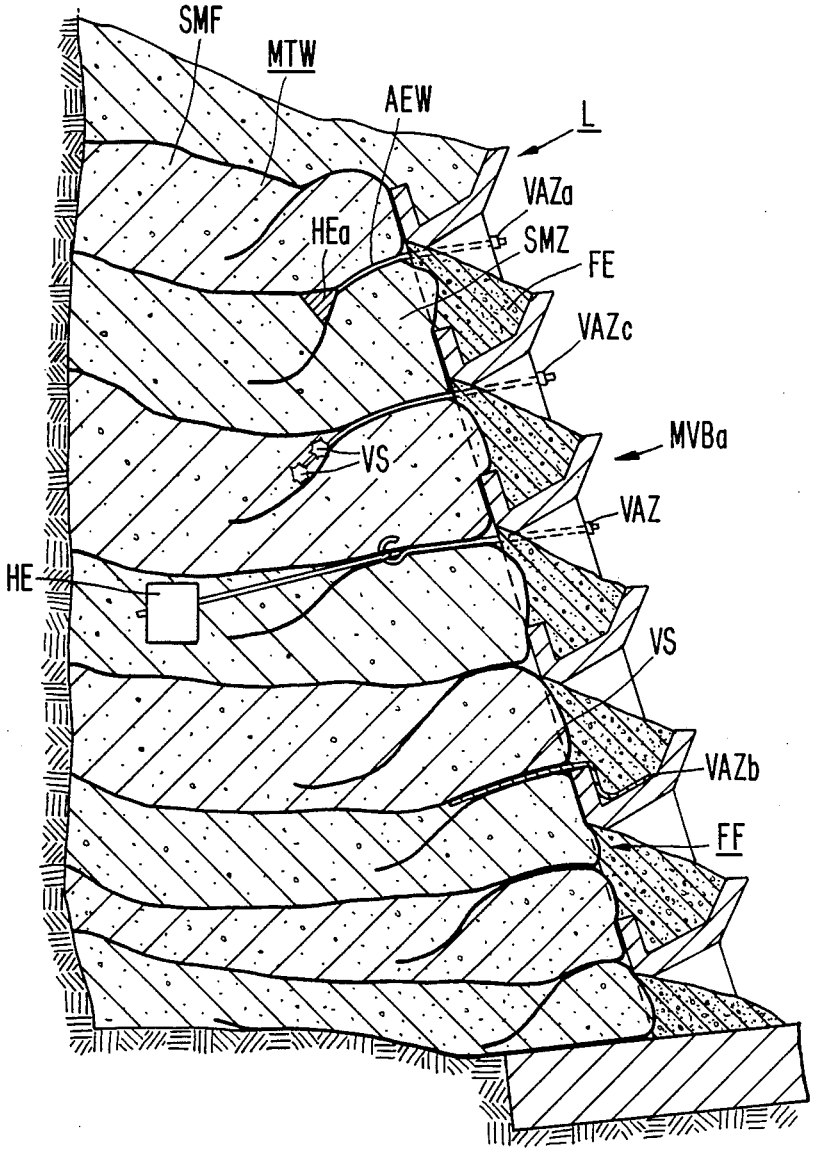
FIG. 4 is a cross-sectional view of a slope supporting wall and illustrating various anchoring elements.

For the purpose of explanation three different modes of anchoring the foreparts have been shown in FIG. 10:

In the lowermost stage of the wall two building elements located in opposition to each other and on the same level are both anchored independently by means of anchoring sections ASE of the envelope material being part of the bulk material cells housed in excavations of the building elements BET. The anchoring sections ASE extend into the bulk material of the gravity support structure so as to form a substantial frictional connection therewith. Additional positive anchoring or holding parts or elements as shown in FIG. 4 may be used here also.

In the following upper stage of the wall two building elements located in opposition to each other and on the same level are shown anchored to each other by means of common anchoring section ASC of the envelope material being part of both the bulk material cells housed in excavations of the corresponding building elements. Such inexpensive construction renders favorably enhanced compound stability.

In the third stage of the wall a common anchoring mode similar to the preceding stage has been shown, however, without making use of the envelope material of bulk material cells. Instead a common tensile anchoring element AET in the form of a rope or band is used, which surrounds the back ribs BR of both building elements and extends through the bulk material located between both foreparts. It has to be pointed out that this mode of anchoring offers optimum stability due to the possibility of tensioning the common anchoring element or elements in the different stages of the wall precisely. Furthermore, optimum form stability is secured for the whole stand-alone wall.

Figure 11:
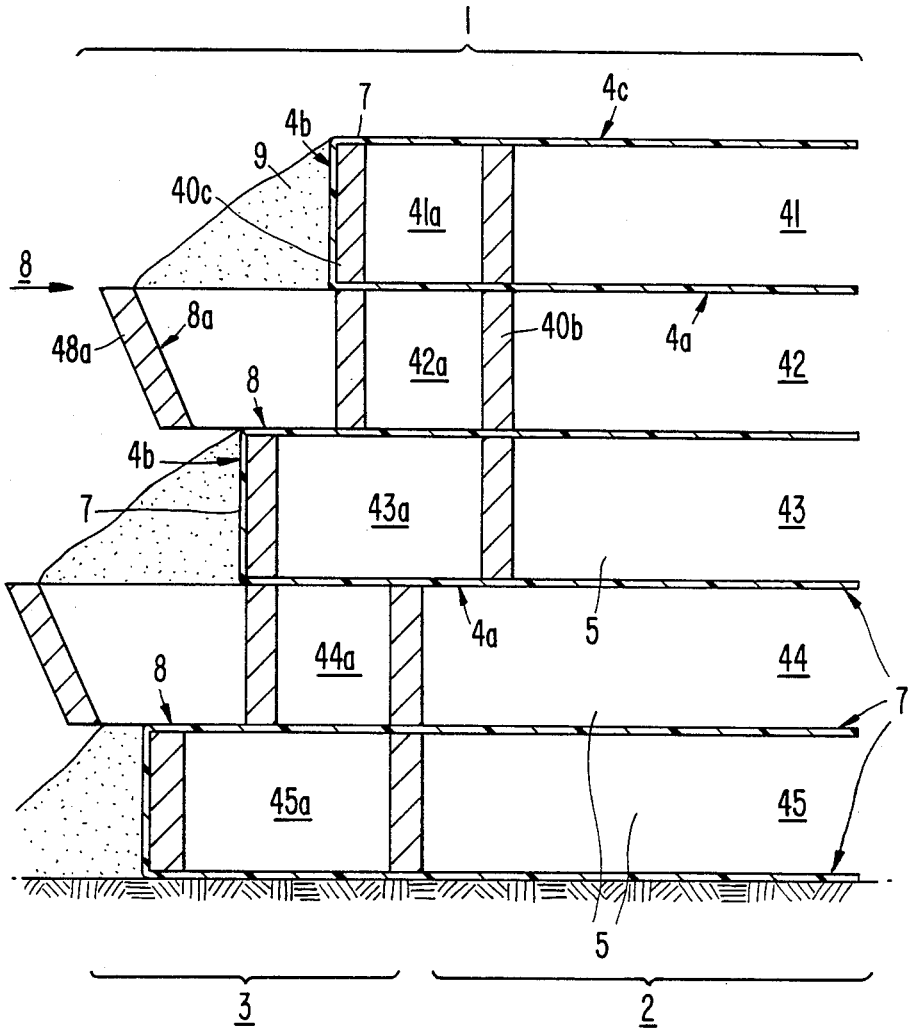
FIG. 11 is a vertical cross-sectional view of an alternate embodiment of a slope supporting wall.

FIG. 11 illustrates in a vertical cross-section a wall 1 comprising a support structure 2 and a forepart 3. The support structure 2 includes a plurality of vertically arranged compartments 41 to 45 filled with bulk material 5. As shown for the compartment 41 only, these compartments have a bottom face 4*a*, a front face 4*b* oriented towards the front 6 of the wall and an upper face 4*c*. The front, bottom and upper faces of compartments 41, 43 and 45 are defined by flexible envelope material 7 extending along said faces. Only the bottom and upper faces of compartments 42 and 44 are likewise defined by flexible envelope material, while the front faces have been left free. The forepart 3 comprises a plurality of support elements 41*a* to 45*a* arranged one above the other. They have also bottom, front and upper faces as evident from the illustration. The flexible envelope material defining the faces of compartments 41, 43 and 45 is elongated so as to cover the front faces of support elements 41*a*, 43*a* and 45*a* also.

In comparison with known walls, the front faces of which are formed substantially by front sections of flexible envelopes filled with bulk material, one of the advantages realized by the structure just described is the enhanced stability and rigidity of the front structure and, thereby, the enhanced supporting capability of the wall acting against the gravity pressure of earth and boulder material behind the wall.

A further major feature of the wall as just described has to be recognized in that there are differently arranged first and second support elements. The first ones are said elements 41*a* and 43*a*, the front faces of which are surrounded and covered by a section of flexible envelope material 7 extending out of the bulk material behind the forepart. The second ones are said elements 42*a* and 44*a*, each of which is arranged beneath one of the said first support elements and in supporting connection therewith. The front faces of said second support elements are left free of flexible envelope material and shaped so as to project in direction towards the front 6 of the wall beyond the corresponding first support element arranged thereabove. Each of those second support elements forms a bearing surface 8 for a bulk material forefilling 9 covering at least partly the front face of said first support element arranged thereabove.

While supporting capability for many applications is not too much diminished by omitting the anchoring-by-envelopement effect for each second one of said support elements arranged one above the other, a substantial advantage is the covering of the front sections of the flexible envelope material by the said bulk material forefilling. This shields the flexible material, mostly consisting of plastics, from deterioration by ultraviolet irradiation. Furthermore, the slope surfaces formed by the forefilling offers sufficient basis for various plants as desired in view of landscape architecture.

A further important feature of the wall structure shown in FIG. 11 is based on the specific design of the support elements, such as elements 42*a* and 44*a* arranged therein. These elements comprise a front board section 40*a* extending in a direction along the front face of the wall. This board section forms an additional bearing surface 8*a* for bulk material, which together with the basic bearing surface 8 explained above offers an enhanced root space for plants and secures the bulk material filling against erosion. Further there is a rear support section 40*b* extending in vertical direction so as to form bearing connections with the adjacent wall elements. An intermediate support section 40*c* also extending in vertical direction so as to form bearing connections with the adjacent wall elements. This double supporting connection by two support sections offset against each other in horizontal direction secures the elements positively against tilting and thus enhances the overall wall stability. It has to be understood that in view of heavy load conditions more than two such vertically extending support sections may be advisable.

In particular said rear and intermediate support sections are formed as rear or intermediate supporting board sections extending substantially in a direction along the front face of the wall. This contributes to enhanced stability of such sections against vertical pressure and allows a comparatively inexpensive production by way of profile casting in concrete due to the overall profile-like shape of said support elements.

Figure 12:
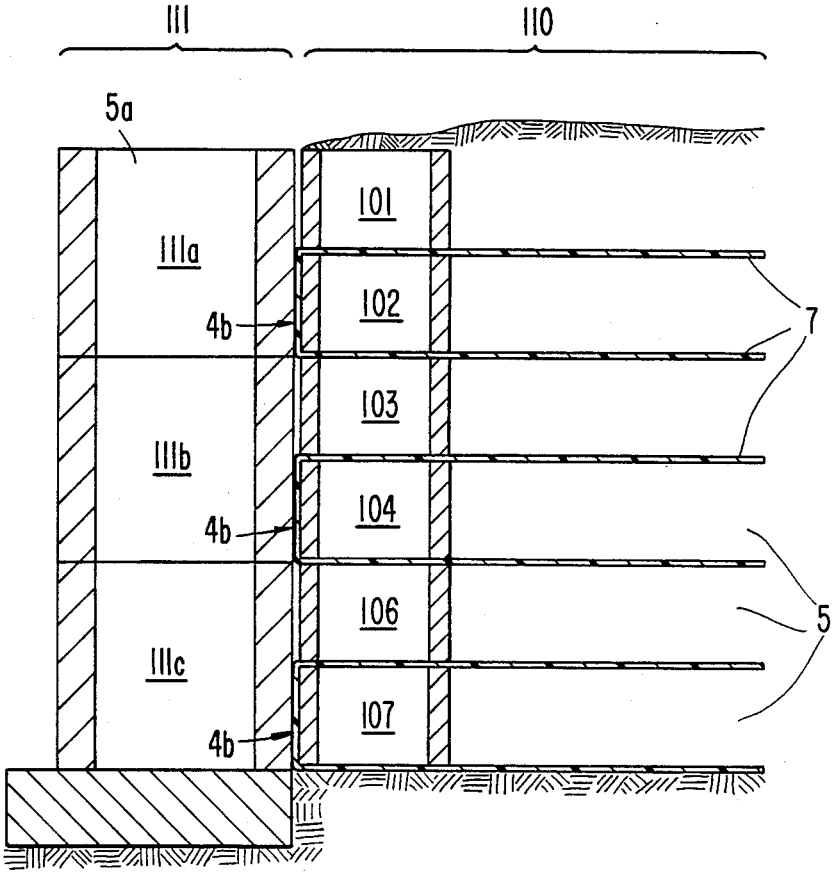
FIG. 12 is a vertical cross-sectional view of another alternate embodiment of a slope supporting wall.

FIG. 12 illustrates an example of a different scheme for covering and securing the front sections 4*b* of the flexible envelope material 7 defining bearing compartments within a rear support structure 110. The front assembly of said rear support structure is formed by profile beams 101 to 107 superimposed one to the other. A forepart 111 comprising a plurality of mutually superimposed auxiliary support elements 111*a* to 111*c* of box-like design, but lacking a bottom section and thus forming a vertical throughout channel filled with bulk material 5*a*, covers and supports the front sections of the flexible envelope material. Such forepart contributes substantially to the overall support capability of the wall.

Figure 13:
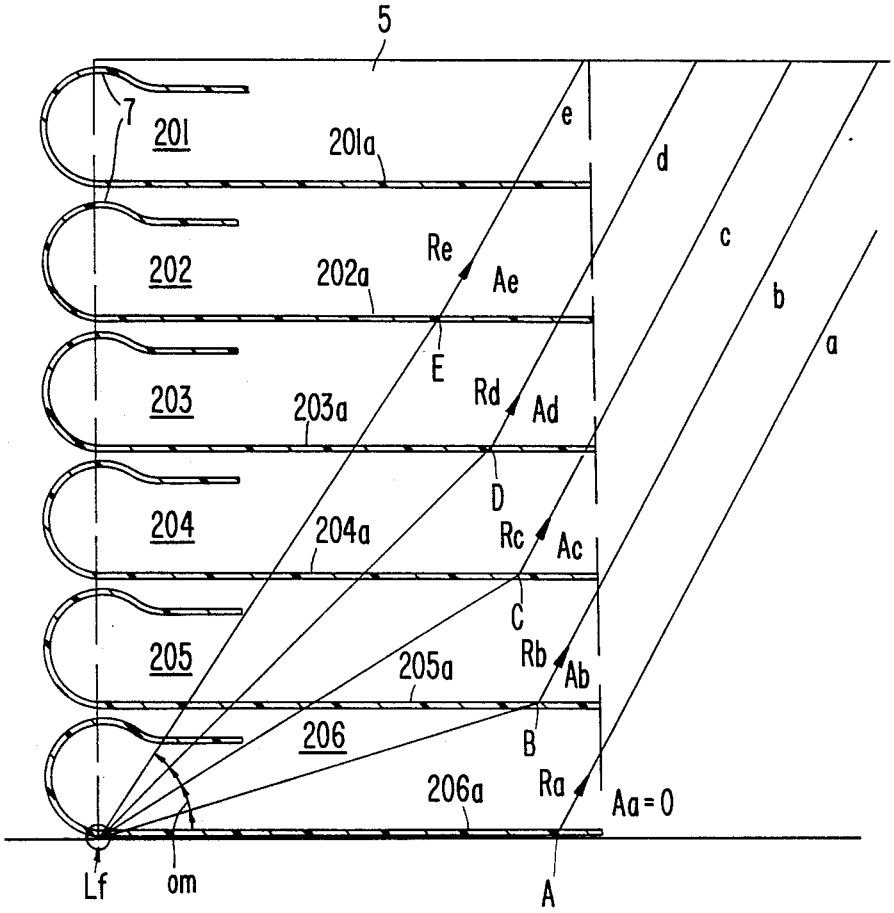
FIG. 13 is a side view of a bulk material wall with flexibly enveloped compartments within the adjacent bulk material.

FIG. 13 illustrates a bulk material wall with flexibly enveloped compartments 201 to 206 within the adjacent bulk material. Elongated anchoring sections 201*a* to 206*a* are embedded between mutually superimposed layers of bulk material substantially in horizontal planes. The stability conditions and supporting capability against earth pressure for such a structure is investigated by a method well known in the art, which method comprises calculating for each one of a representative plurality of slide-planes the sum or integral of the effective earth-pressure or slide-inducing forces in comparison with the sum or integral of the frictional holding forces within the bulk material, the frictional holding forces acting between the anchoring sections of the flexible envelope material and the adjacent bulk material and the holding tensile anchoring forces introduced through the intersections between the slide plane and said anchoring sections of the envelope material. In FIG. 13 slide planes a to e and their intersections A to E with anchoring material sections 206 to 202 have been schematically illustrated, furthermore the resultants of Ra to Re of the holding frictional forces and the anchoring forces Aa to Ae, all acting in said intersections.

As illustrated in FIG. 13, the sliding planes consist of two sections, namely firstly lower ones all starting in the common foot-line Lf and characterized by the slope angle om for each plane, and secondly upper ones starting in said intersections A to E respectively. The slope of all the last-mentioned sections of the slide-planes is the same, namely according to the inherent friction angle of the bulk material (not specifically designated in the illustration).

Figure 14:
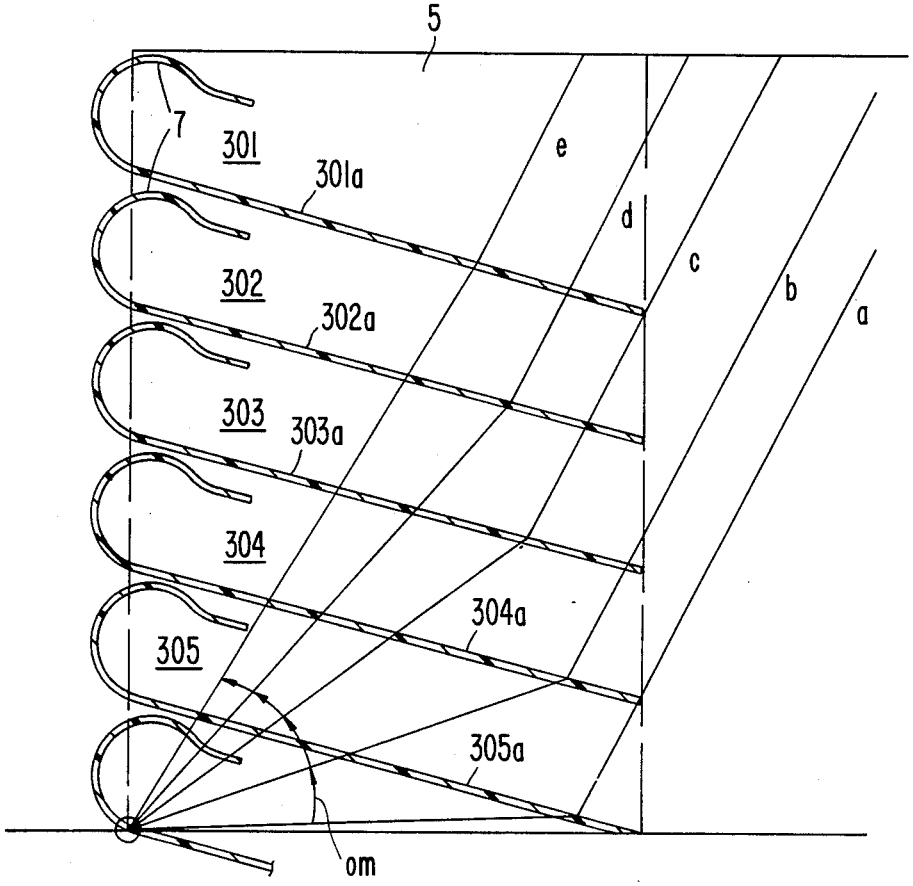
FIG. 14 is an alternate embodiment of the slope supporting wall shown in FIG. 13.

In contrast thereto, FIG. 14 shows a wall structure similar to FIG. 13 and comprising superimposed bulk material compartments 301 to 305 enveloped by flexible material 7, however, with a specifically inclined arrangement of the effective holding sections 301*a* to 305*a* thereof. Slide-planes a to e characterized by their slope angle om have been assumed in accordance with the known structure shown in FIG. 13. The same markings and designations apply as illustrated in FIG. 13, but they have been omitted for the sake of clarity.

Thorough investigations have shown that within a broad scope of applications favorable results are obtained by means of envelope-slope angles within a range from approximately 10 to 30 degrees in relation to the horizontal. Specifically for heavy load applications a slope angle within a range from approximately 18 to 24 degrees in relation to the horizontal has proved to be the best mode of operation.

Figure 15:
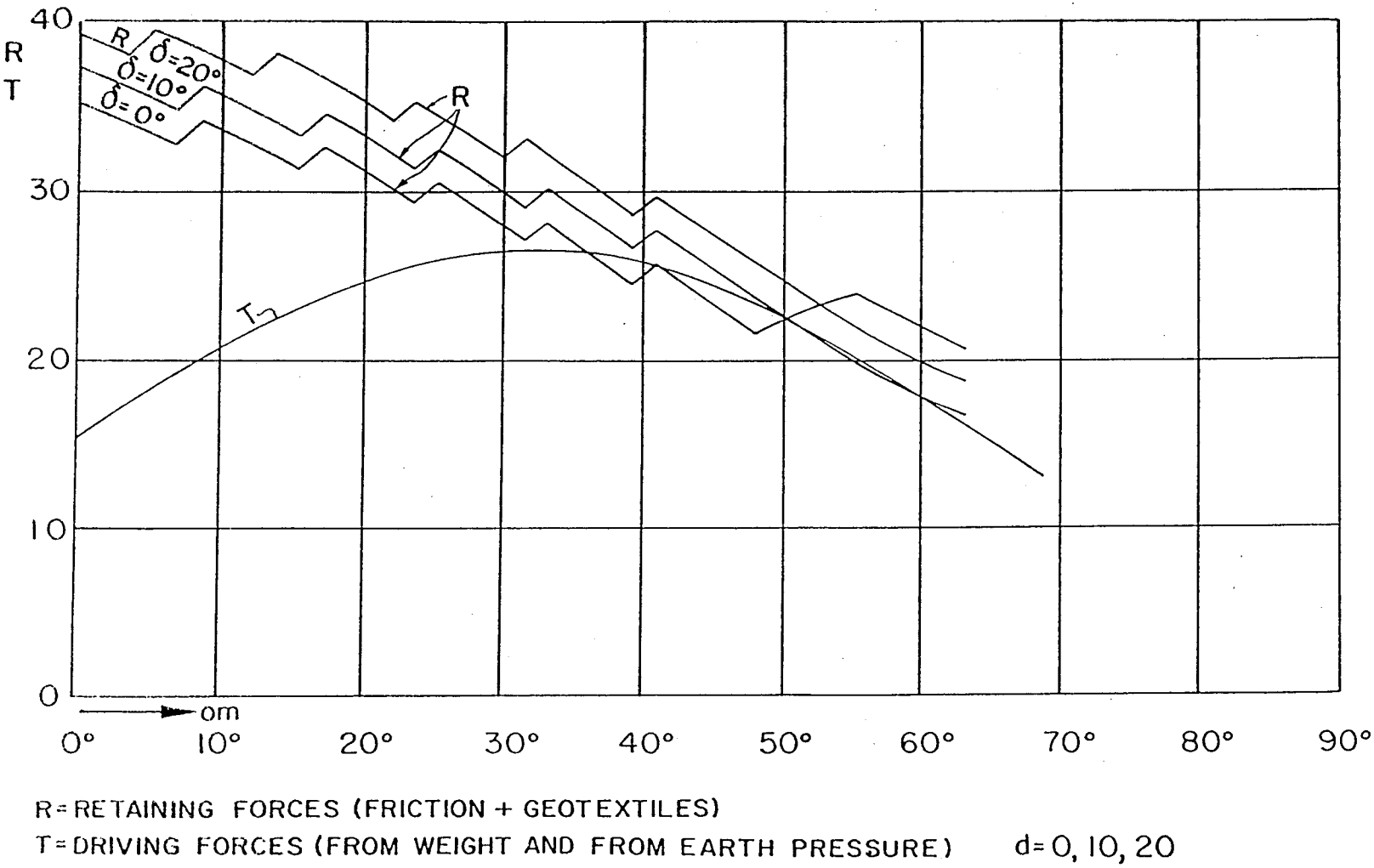
FIG. 15 is a diagram relating driving forces, retaining forces and slope angle.

The diagram of FIG. 15 illustrates firstly by the curve T the dependency of the earth mass gravity driving force on the slope angle om of the different sliding faces within the block of earth, as is well known for any expert in the field. Furthermore, three curves of the earth retaining force being effective in the said different sliding faces characterized by the corresponding slope angle om. For each of those curves the tearing section of the geotextile layers extends under a different angle d with regard to the horizontal, as depicted in FIG. 14 for the example of one specific value of d. The steps of the curves R result from the increasing number of bearing geotextile sections becoming effective at certain angles om in succession. Any sliding angle for which the curve R falls below the curve T represents a critical condition. Obviously, increasing values of d make it possible to obtain overall safety with the same amount of geotextile.

What I claim is:

1. A wall, particularly constructed as a slope-supporting wall, comprising a support structure with a plurality of compartments, each compartment being at least partially defined by flexible sheet material that extends along layers of bulk material, the wall further comprising at least one forepart, said forepart including a rear side adjacent said support structure, said rear side including at least one supporting element projecting at an angle, particularly transversely, in relation to the direction in which said flexible sheet material extends along said layers of bulk material, said rear side further including at least one space neighboring said supporting element and being arranged at least partially offset in relation to said supporting element in a direction towards a front side of said forepart, at least a part of said flexible sheet material extending from said support structure into said space and over said projecting element so as to form a positive connection with said forepart.

2. A wall according to claim 1 in which said forepart is constructed of narrow trough-like building elements so as to be tilt-resistant, said elements connected with said supporting structure so as to balance a portion of bulk material pressure in said support structure.

3. A wall according to claim 2, further including a pressure transmitting space provided between a front side of said support structure and said forepart, said pressure transmitting space being filled with low-density bulk material.

4. A wall according to claim 1, in which said forepart is constructed of a plurality of superimposed building elements, said elements being inclined toward said building structure and maintained in said inclined position by distance elements positioned in said support structure, whereby said forepart forms a tilt-resistant unit with said support structure.

5. A wall according to claim 1, further including two opposite front sides formed by two corresponding foreparts and further including a central support structure positioned between said two foreparts.

6. A wall according to claim 5 further comprising at least one anchoring structure for connecting said two foreparts.

7. A wall according to claim 6, in which said anchoring structure comprises at least one flexible tensile anchoring element in the form of flexible flat material.

8. A wall according to any one of the preceding claims, in which said forepart comprises a grid structure containing a bulk material filling.

9. A wall according to claim 1 wherein said forepart comprising a grid structure including a plurality of building elements, each having a front side and a rear side, in which in the region of each said rear side there is formed at least one projection directed upwards, and at least one space formed in each said element neighboring said projection and being arranged offset in relation thereto in a direction towards said front side.

10. A wall according to claim 9, in which each projection is formed as a rib extending substantially parallel to the plane of the rear side of said forepart.

11. A wall according to claim 9, in which each said building element comprises a serial arrangement of projections in the region of the rear side of each element, said serial arrangement extending substantially in parallel to the plane of the rear side of said forepart.

* * * * *